US007395587B2

(12) United States Patent
Catallo et al.

(10) Patent No.: US 7,395,587 B2
(45) Date of Patent: Jul. 8, 2008

(54) APPARATUS FOR CONTROLLING A COMPRESSION ZONE IN A COMPRESSIVELY SHRINKING FABRIC WEB

(76) Inventors: Frank Catallo, 84 Wheatley Rd., Old Westbury, NY (US) 11568; Uwe Seidel, 100 Asbury Ave., Westbury, NY (US) 11050

( * ) Notice: Subject to any disclaimer, the term of this patent is extended or adjusted under 35 U.S.C. 154(b) by 418 days.

(21) Appl. No.: 10/942,670

(22) Filed: Sep. 16, 2004

(65) Prior Publication Data

US 2006/0053603 A1 Mar. 16, 2006

(51) Int. Cl.
*D06C 21/00* (2006.01)

(52) U.S. Cl. ..... 26/18.6

(58) Field of Classification Search ..... 26/18.6, 26/18.5; 28/116, 134, 136, 138, 139, 165, 28/156, 155; 162/111, 280, 281
See application file for complete search history.

(56) References Cited

U.S. PATENT DOCUMENTS 3,015,145 A * 1/1962 Cohn et al. ..... 26/18.6
3,015,146 A * 1/1962 Cohn et al. ..... 26/18.6
3,452,409 A * 7/1969 Trifunovic et al. ..... 26/18.6
3,681,819 A * 8/1972 Trifunovic et al. ..... 26/18.6
3,973,303 A * 8/1976 Diggle, Jr. ..... 26/18.6
4,142,278 A * 3/1979 Walton et al. ..... 26/18.6
4,227,288 A * 10/1980 Moser ..... 26/18.6
4,363,161 A * 12/1982 Catallo ..... 26/18.6
4,882,819 A * 11/1989 Milligan et al. ..... 26/18.6
5,012,562 A * 5/1991 Catallo ..... 26/18.6
5,117,540 A * 6/1992 Walton et al. ..... 26/18.6
5,655,275 A * 8/1997 Allison et al. ..... 26/18.6
6,681,461 B1 * 1/2004 Catallo ..... 26/18.6

* cited by examiner

*Primary Examiner*—Amy B. Vanatta
(74) *Attorney, Agent, or Firm*—Charles E. Baxley

(57) ABSTRACT

Devices for adjusting positions of: a removable slip sheet in a compression zone defined by a pair of rollers of an open width textile compressive shrinking machine to adjust a size of the compression zone for various thickness and types of textiles; a wedge between the pair of rollers for spacing apart the pair of rollers a predetermined dimension; and a shoe in the compression zone for allowing for different thickness and types of textiles.

21 Claims, 4 Drawing Sheets

APPARATUS FOR CONTROLLING A COMPRESSION ZONE IN A COMPRESSIVELY SHRINKING FABRIC WEB

BACKGROUND OF THE INVENTION

1. Field of the Invention

The present invention relates to an apparatus for controlling a compression zone in a compressively shrinking fabric web, more particularly, the present invention relates to apparatus for adjusting positions of: a removable slip sheet in a compression zone defined by a pair of rollers of an open width textile compressive shrinking machine to adjust a size of the compression zone for various thickness and types of textiles; a wedge between the pair of rollers for spacing apart the pair of rollers a predetermined dimension; and a upper shoe in the compression zone for allowing for different thickness and types of textiles.

2. Description of the Prior Art

The knitting industry uses, for manufacture of garments, various compacted knitted textile fabrics of different constructions, generally accepted as having been shrink-proofed. For such compressive shrink-proofing, two-pass types of compactor have been in vogue; as disclosed in each of U.S. Pat. Nos. 4,689,862 and 5,655,275; which compactors are typical of machines used for knitted fabric made of natural and/or man-made fibers. Although these compactors produce generally acceptable shrink-proofing results, they are temperamental and require frequent re-adjusting of their compression zones.

U.S. Pat. No. 5,016,329 uses two stationary opposing blades to form a compression zone. A fabric being compacted is required to change direction abruptly on entering and exiting the compression zone. Applicant's GULL-WING brand compactor, disclosed in U.S. Pat. No. 5,012,562, employs a compression zone consisting of an apex (or nadir) of a stationary notched shoe and an opposing impact blade with the fabric being compacted required to make a "V" turn in passing through a compression zone. Common to the prior art compactors presently used for shrink-proofing knitted textile fabrics is a requirement for an abrupt change of direction of fabrics due to an organized obstruction in their respective compression zones. The abrupt change of direction contributes tojamming; for example, at the apex of the GULL-WING brand compactor. A single-pass in-line compression zone taught by Applicant's U.S. Pat. No. 6,681,461, whose disclosure is included herein by reference, eliminates the abrupt change of direction to render the compactor taught by Applicant's U.S. Pat. No. 6,681,461 more operator-friendly, knit-friendly and produces trouble-free superior shrink-proofing on a wide variety of constructions of knitted textile fabrics and other fabrics having characteristics kindred to knitted textile fabrics.

Compressive shrink-proofing of knitted textile fabrics, formed from interlocked loops of yarns made usually of natural fibers or man-made fibers had its origin in shrink-proofing of woven textile fabric webs. With increased popularity of knitted garments, compressive shrink-proofing of knitted textile fabrics evolved from prior experience obtained by working with flat woven textile fabric webs. Woven textile fabrics webs are rectilinear grids ofthreads having longitudinal warp threads interwoven by transverse fill threads. Emphasis in compaction for shrink-proofing of woven textile fabric webs naturally focused on a need for longitudinal compression. The woven textile fabrics were, and are, manufactured in such continuous webs which inevitably get stretched lengthwise while being woven, transported, and processed. So it was, and is logical, convenient and effective to shrink compressively the woven fabric webs in a longitudinal direction along their flat continuous webs. However, knitted textile fabrics, like randomly deposited fabrics made of natural or man-made fibers, are neither formed nor structured similarly to woven textile fabrics.

Knitted textile fabrics, for example, are composed of yarns, usually of natural fibers, formed in interlocking curvilinear loops which are arranged in stitch rows sometimes aligned perpendicularly to and sometimes skewed from perpendicular orientations relative to alignment of their continuous webs. The loops generally interlock with each other substantially at right angles (orthogonally) to their respective stitch row. It is sometimes convenient to visualize stitch rows ideally as being straight and aligned transversely relative to a longitudinal path of the fabric, like soldiers marching on parade through their compactor. Yet such an ideal image of stitch rows through a compactor rarely finds its counterpart in the real world. Knitted textile fabrics frequently are not designed with straight transverse stitch rows. Handling and treatment of knitted textile fabrics warp, bend, twist, and otherwise distort their stitch rows. Further, the stitch rows themselves are formed as a progression of repeating series of curvilinear loops of yarn. So as far as compacting of knitted textile fabrics is concerned, terms such as "straight" or "aligned" stitch rows are wishful euphemisms.

A loop of yarn in a knitted fabric actually exhibits behavior characteristics quite different from those that logically might be expected from an ideal image of stitch rows. Applicant examined behavioral characteristics of actual knitted structures as they undergo compaction, so as to deal on their own terms with the loops and stitch rows as they actually exist.

The knitted textile fabrics, when composed of natural fibers, typically are manufactured in the form of continuous tubes which are then flattened and compacted in a longitudinal direction in analogous fashion to compacting of woven textile fabrics. Alternately, the knitted tubes may be split open, spread, and subjected to longitudinal compacting as open webs. Knitted textile fabrics, with small loops or fine yarns making up the loops, require compaction as open webs. As has been noted herein, technology which evolved from compacting of woven textile fabric webs generally has achieved inconsistent success in treating knitted textile fabrics. Lack of consistent success has been common to compaction of knitted textile fabrics both as tubes and as open webs. Accordingly, some people look upon compressive shrinking of knitted fabrics as an occult art.

In actual knitted textile fabrics, we frequently can expect unreliable orientation (skewing) of stitch rows formed of interlocked yarn loops. And, alignment of the loops has been recognized by Applicant to occur orthogonally, each individual loop relative to its related skewed stitch row. Applicant's recognition, acceptance, and accommodation of the skewed orientation of the stitch rows and inherent behavior of the loops relative to their respective stitch rows are at the crux of Applicant's successful, consistent and reliable compacting of knitted textile fabrics and other similar fabrics made of natural and/or man-made fibers. It followed that organizing apparatus and a related method for freeing the interlocked loops of yarn to move easily, as they naturally choose, toward each other orthogonally relative to their skewed stitch rows, opened the door to Applicant's success.

Effective compressive shrink-proofing of knitted textile fabrics of natural fibers depends in part on expansion of heated and/or moistened yarn caused by partial unraveling of their fibers. Steam puffing and lubricating effects on natural yarn loops of knitted textile fabrics are discussed in Applicant's U.S. Pat. No. 4,447,938, whose disclosure is included herein by reference. Another reality of compaction is that the fabric reduces in volume by mechanical pushing of the interlocked loops of yarn preferably toward each other. Applicant's U.S. Pat. No. 6,681,461 focuses on the mechanical pushing action.

The loops interlock generally at right angles (orthogonally), each relative to its related stitch row. With the stitch rows unreliably organized, and the yarn loops arranged orthogonally thereto, application of longitudinal compaction through a crimped, bent, kinked, or otherwise obstructed compression zone was effective along a series of longitudinal vectors from a continuum of points along a curvilinear loop of yarn. Simultaneously, a series of companion transverse vectors of any, or all, of the same points could thereby be either wasted or they could contribute to counterproductive stretching. Accordingly, a substantial portion of longitudinal compacting effort on knitted textile fabrics was self-defeating when performed though the crimped, bent, kinked, or otherwise obstructed compression zones of the prior art. By eliminating abrupt direction change, due to obstruction, as the web of knitted fabric passes through the compression zone, Applicant frees the loops, each to move according to its own natural preference, which Applicant recognized to be orthogonally relative to its related stitch row, unaffected by likely skewed orientations of the stitch rows that make up the web of knitted fabric.

Applicant had in Applicant's U.S. Pat. No. 6,681,461 approached compacting of knitted textile fabrics by delivering and removing a confined web of the fabric, usually heated and/or moistened, through a substantially in-line compression zone wherein the loops of yarn of the fabric web, while expanding due to partial unraveling, are allowed to reduce in volume by the loops being pushed together, each according to its own natural preference orthogonally relative to a skewed axis of its respective stitch row. By eliminating crimps, bends, kinks, and other obstructions at the compression zone, Applicant avoided limiting the compacting effort to being only longitudinally directed relative to the fabric web and thus Applicant avoids the counterproductive stretching. Employing this approach, Applicant allowed the expanding loops to move as they choose according to inherent influences of their composition, history, and knitted structure in the easiest and most natural way they can find so as to each reduce its own volume. By this teaching, the direction of movement of the interlocked yarn loops is toward each other orthogonally relative to their respective stitch rows, independent of how bent, warped, twisted, or otherwise skewed those stitch rows may be.

Because of Applicant's novel, useful, and non-obvious approach, the apparatus taught by Applicant's U.S. Pat. No. 6,681,461 is inexpensive to build, easy to operate, and more reliable than apparatuses of the prior art. He achieved operator-friendly, knit-friendly, superior and more reliable compaction of knitted textile fabrics and similar fabrics than has heretofore been achievable. His compactor contributed toward its goal by eliminating counterproductive tensions. He achieved his objective without polishing, crimping, or grabbing of the knitted fabric. Applicant's apparatus and related method for shrinking of knitted textile fabrics made of natural fibers taught by Applicant's U.S. Pat. No. 6,681,461 also is applicable to fabrics made from man-made fabrics, non-woven textiles, papers, papers with additives, and the like; because their formations and structural characteristics are generally random and much more similar to those of knitted textile fabrics than they are to those of woven textile fabrics. Further, the invention taught by Applicant's U.S. Pat. No. 6,681,461 was easily retrofittable into a wide variety of existing compressive shrink-proofing apparatuses. Single-station double-roller compressive shrink-proofing apparatuses are the most likely candidates for retrofitting.

Numerous other innovations for fabric shrinking related devices have been provided in the prior art. Even though these innovations may be suitable for the specific individual purposes to which they address, they each differ in structure and/or operation and/or purpose from the present invention since they do not teach devices for adjusting positions of: a removable slip sheet in a compression zone defined by a pair of rollers of an open width textile compressive shrinking machine to adjust a size of the compression zone for various thickness and types of textiles; a wedge between the pair of rollers for spacing apart the pair of rollers a predetermined dimension; and a shoe in the compression zone for allowing for different thickness and types of textiles.

SUMMARY OF THE INVENTION

ACCORDINGLY, AN OBJECT of the present invention is to provide devices for adjusting positions of: a removable slip sheet in a compression zone defined by a pair of rollers of an open width textile compressive shrinking machine to adjust a size of the compression zone for various thickness and types of textiles; a wedge between the pair of rollers for spacing apart the pair of rollers a predetermined dimension; and a shoe in the compression zone for allowing for different thickness and types of textiles that avoid the disadvantages of the prior art.

ANOTHER OBJECT of the present invention is to provide devices for adjusting positions of: a removable slip sheet in a compression zone defined by a pair of rollers of an open width textile compressive shrinking machine to adjust a size of the compression zone for various thickness and types of textiles; a wedge between the pair of rollers for spacing apart the pair of rollers a predetermined dimension; and a shoe in the compression zone for allowing for different thickness and types of textiles that are simple to use.

BRIEFLY STATED, STILL ANOTHER OBJECT of the present invention is to provide devices for adjusting positions of: a removable slip sheet in a compression zone defined by a pair of rollers of an open width textile compressive shrinking machine to adjust a size of the compression zone for various thickness and types of textiles; a wedge between the pair of rollers for spacing apart the pair of rollers a predetermined dimension; and a shoe in the compression zone for allowing for different thickness and types of textiles.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWINGS

The figures of the drawing are briefly described as follows.

LIST OF REFERENCE NUMERALS UTILIZED IN THE DRAWINGS

Figure 1:
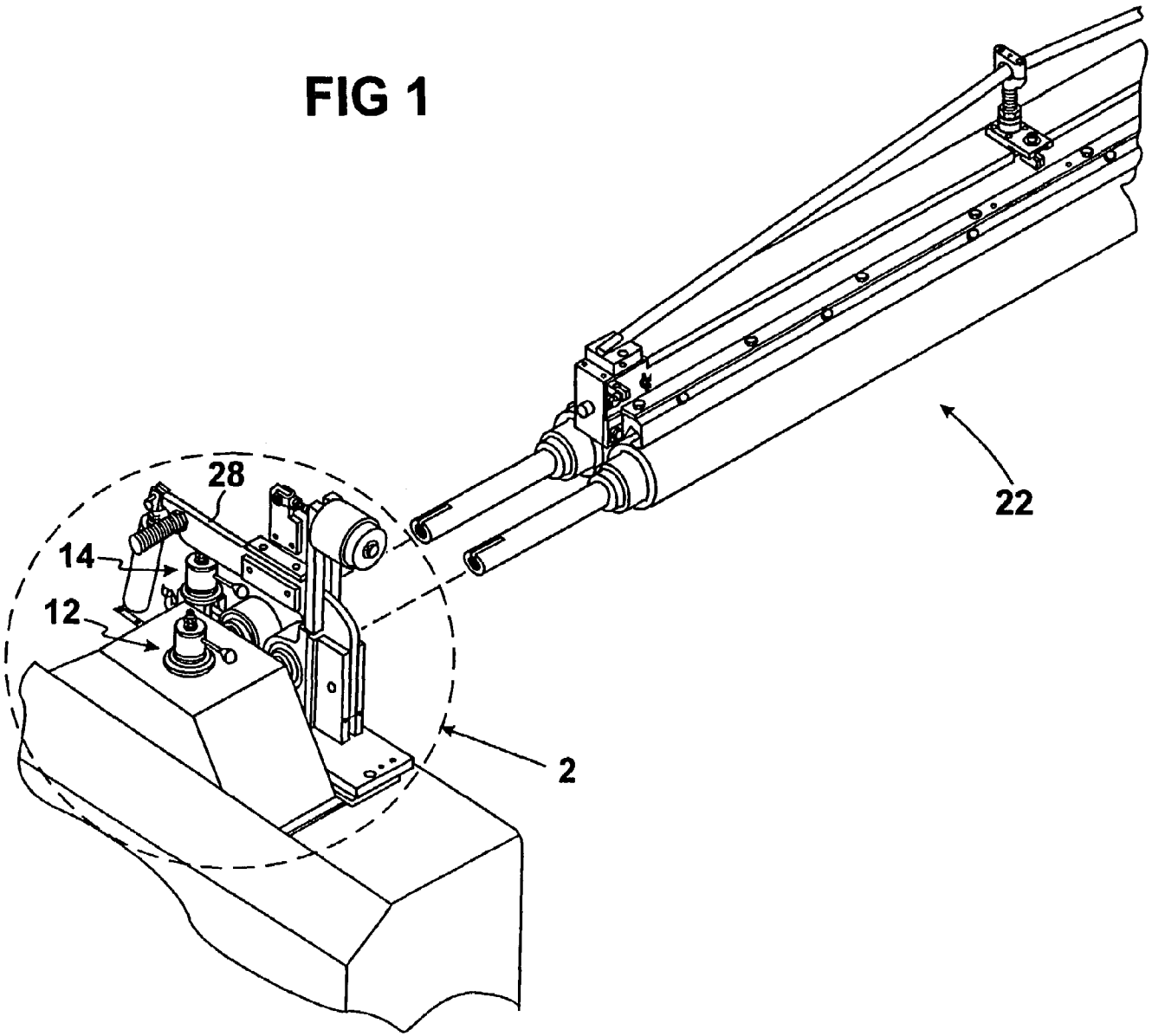
FIG. 1 is an exploded diagrammatic perspective view of an open width textile compressive shrinking machine utilizing the devices of the present invention for adjusting positions of: a removable slip sheet in a compression zone defined by a pair of rollers of the open width textile compressive shrinking machine to adjust a size of the compression zone for various thickness and types of textiles; a wedge between the pair of rollers for spacing apart the pair of rollers a predetermined dimension; and a shoe in the compression zone for allowing for different thickness and types of textiles.

10 device for adjusting position of removable slip sheet 16 in compression zone 18 defined by pair of rollers 20 of open width textile compressive shrinking machine 22 to adjust size of compression zone 18 defined by pair of rollers 20 of open width textile compressive shrinking machine 22 for various thickness and types of textiles

12 device for adjusting position of wedge 24 between pair of rollers 20 of open width textile compressive shrinking machine 22 for spacing apart pair of rollers 20 of open width textile compressive shrinking machine 22 predetermined dimension

14 device for adjusting position of shoe 26 in compression zone 18 defined by pair of rollers 20 of open width textile compressive shrinking machine 22 for allowing for different thickness and types of textiles

16 removable slip sheet

18 compression zone defined by pair of rollers 20 of open width textile compressive shrinking machine 22

20 pair of rollers of open width textile compressive shrinking machine 22

22 open width textile compressive shrinking machine

24 wedge between pair of rollers 20 of open width textile compressive shrinking machine 22

26 shoe of open width textile compressive shrinking machine 22

28 pivotal arm of open width textile compressive shrinking machine 22

30 intermediate arm of open width textile compressive shrinking machine 22

32 inner side of intermediate arm 30 of open width textile compressive shrinking machine 22

34 top of intermediate arm 30 of open width textile compressive shrinking machine 22

36 bottom of intermediate arm 30 of open width textile compressive shrinking machine 22

Device 10 for Adjusting Position of Removable Slip Sheet 16 in Compression Zone 18 Defined by Pair of Rollers 20 of Open Width Textile Compressive Shrinking Machine 22 to Adjust Size of Compression Zone 18 of Open Width Textile Compressive Shrinking Machine 22 for Various Thickness and Types of Textiles

38 bracket for having removable slip sheet 16 depend therefrom and for being movably mounted to intermediate arm 30 of open width textile compressive shrinking machine 22 so as to allow removable slip sheet 16 to move in compression zone 18 defined by pair of rollers 20 of open width textile compressive shrinking machine 22

40 body of bracket 38 for up and down movement on intermediate arm 30 of open width textile compressive shrinking machine 22

42 adjuster of bracket 38 for mounting to intermediate arm 30 of open width textile compressive shrinking machine 22

44 retainer of bracket 38 for having removable slip sheet 16 depend therefrom

46 upright portion of body 40 of bracket 38 for mounting to inner side 32 of intermediate arm 30 of open width textile compressive shrinking machine 22

48 pair of transverse portions of body 40 of bracket 38

50 threaded through bore through upper transverse portion of pair of transverse portions 48 of body 40 of bracket 38

52 plate of adjuster 42 of bracket 38 for affixing to top 34 of intermediate arm 30 of open width textile compressive shrinking machine 22

54 bolt of adjuster 42 of bracket 38

56 through bore through plate 52 of adjuster 42 of bracket 38

57 housing of retainer 44 of bracket 38 for abutting against inner side 32 of intermediate arm 30 of open width textile compressive shrinking machine 22

58 shaft of retainer 44 of bracket 38 for being as wide as removable slip sheet 16 and for capturing removable slip sheet 16 between itself and wall of downwardly tapering walls 66 defining cutout 64 in housing 57 of retainer 44 of bracket 38

60 bolt of retainer 44 of bracket 38

62 bottom of housing 57 of retainer 44 of bracket 38

64 cutout in housing 57 of retainer 44 of bracket 38 for having removable slip sheet 16 depend therefrom

65 bore in housing 57 of retainer 44 of bracket 38

66 downwardly tapering walls defining cutout 64 in housing 57 of retainer 44 of bracket 38

Device 12 for Adjusting Position of Wedge 24 Between Pair of Rollers 20 of Open Width Textile Compressive Shrinking Machine 22 for Spacing Apart Pair of Rollers 20 of Open Width Textile Compressive Shrinking Machine 22 Predetermined Dimension

68 housing

70 shaft

72 inclined plane

74 handle

76 lower end of shaft 70 for having wedge 24 depend therefrom and move therewith

78 inner end of handle 74

80 spring around shaft 70

Device 14 for Adjusting Position of Shoe 26 in Compression Zone 18 of Open Width Textile Compressive Shrinking Machine 22 for Allowing for Different Thickness and Types of Textiles

82 housing

84 shaft

86 inclined plane

88 handle

90 upper end of shaft 84 for having pivot arm 28 of open width textile compressive shrinking machine 22 stop thereupon

92 inner end of handle 88

94 spring of shaft 84

DETAILED DESCRIPTION OF THE INVENTION

Figure 2:
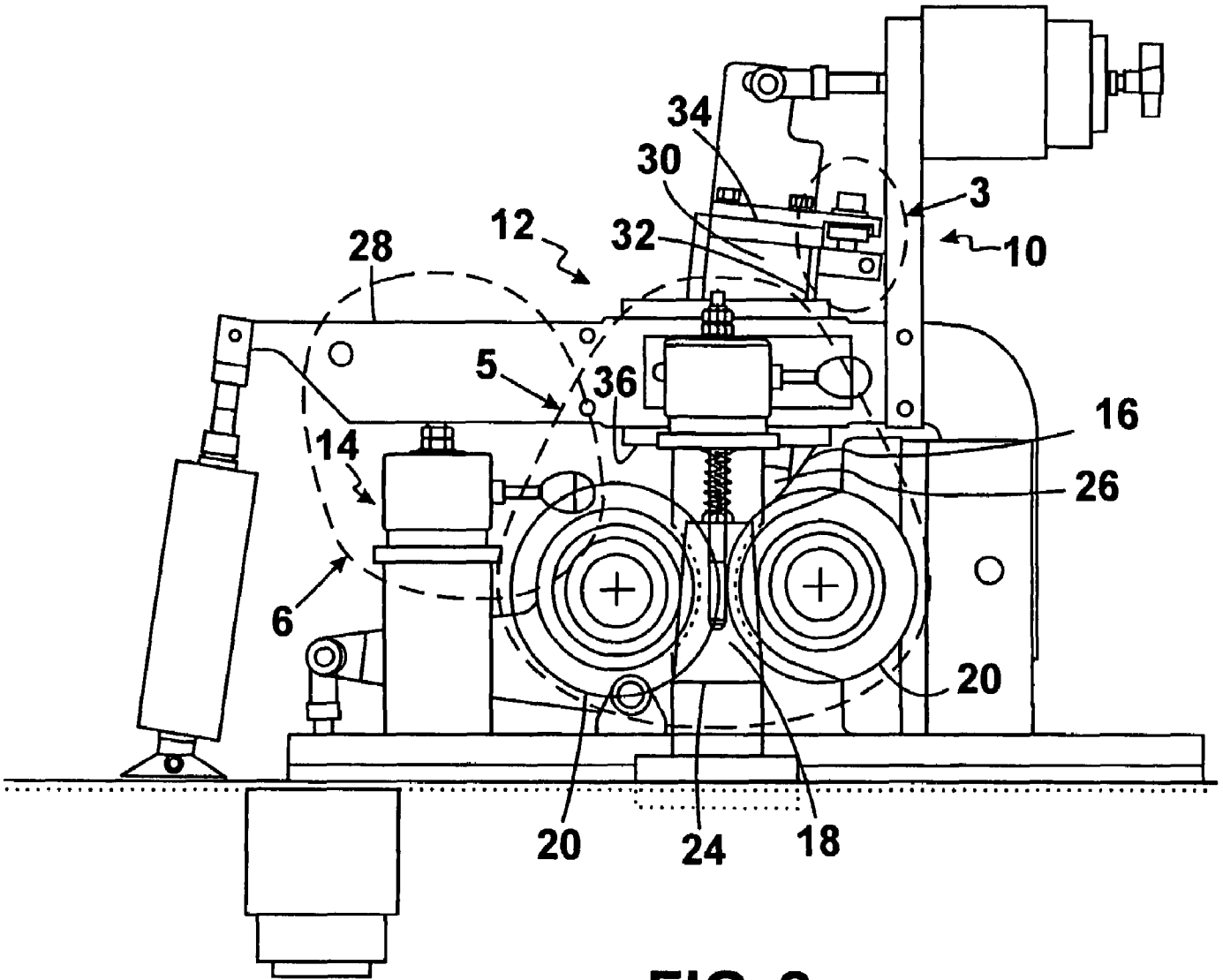
FIG. 2 is an enlarged diagrammatic side elevational view of the area generally enclosed by the dotted curve identified by ARROW 2 in FIG. 1 of the devices of the present invention for adjusting the positions of: the removable slip sheet in the compression zone defined by the pair of rollers of the open width textile compressive shrinking machine to adjust the size of the compression zone for various thickness and types of textiles; the wedge between the pair of rollers for spacing apart the pair of rollers the predetermined dimension; and the shoe in the compression zone for allowing for different thickness and types of textiles.

Referring now to the figures, in which like numerals indicate like parts, and particularly to FIGS. 1 and 2, which are, respectively, an exploded diagrammatic perspective view of an open width textile compressive shrinking machine utilizing the devices of the present invention for adjusting positions of: a removable slip sheet in a compression zone defined by a pair of rollers of an open width textile compressive shrinking machine to adjust a size of the compression zone for various thickness and types of textiles; a wedge between the pair of rollers for spacing apart the pair of rollers a predetermined dimension; and a shoe in the compression zone for allowing for different thickness and types of textiles, and, an enlarged diagrammatic side elevational view of the area generally enclosed by the dotted curve identified by ARROW 2 in FIG. 1 of the devices of the present invention for adjusting the positions of: the removable slip sheet in the compression zone defined by the pair of rollers of the open width textile compressive shrinking machine to adjust the size of the compression zone for various thickness and types of textiles; the wedge between the pair of rollers for spacing apart the pair of rollers the predetermined dimension; and the shoe in the compression zone for allowing for different thickness and types of textiles, the devices of the present invention are shown generally at 10, 12, 14 for adjusting positions of: a removable slip sheet 16 in a compression zone 18 defined by a pair of rollers 20 of an open width textile compressive shrinking machine 22 to adjust size of the compression zone 18 for various thickness and types of textiles, a wedge 24 between the pair of rollers 20 for spacing apart the pair of rollers 20 a predetermined dimension, and a shoe 26 in the compression zone 18 for allowing for different thickness and types of textiles, respectively, wherein the shoe 26 moves with a pivotal arm 28 of the open width textile compressive shrinking machine 22, via an intermediate arm 30 of the open width textile compressive shrinking machine 22, and wherein the intermediate arm 30 has an inner side 32, a top 34, and a bottom 36.

Figure 4:
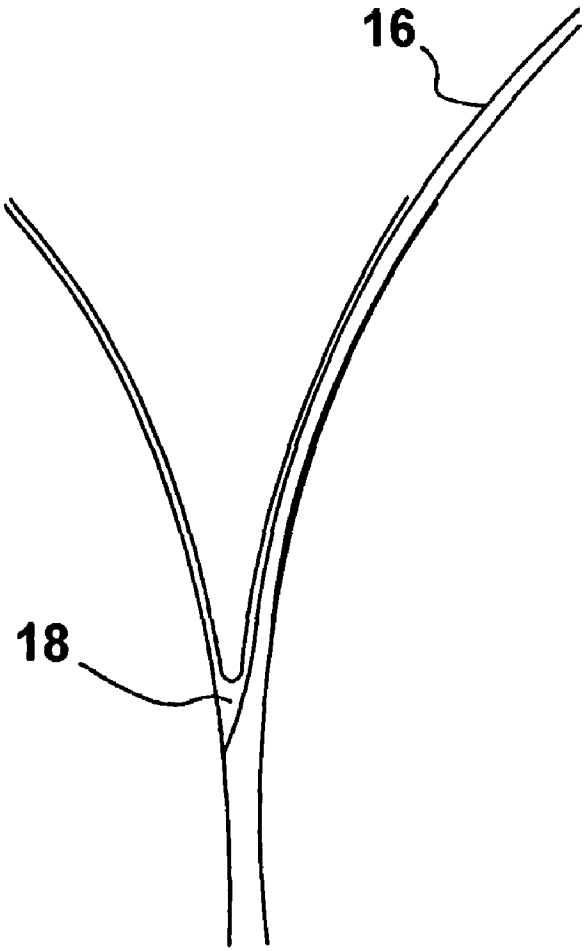
FIG. 4 is an enlarged diagrammatic side elevational view of the area generally enclosed by the dotted curve identified by ARROW 4 in FIG. 3 of the removable slip sheet in the compression zone.
Figure 3:
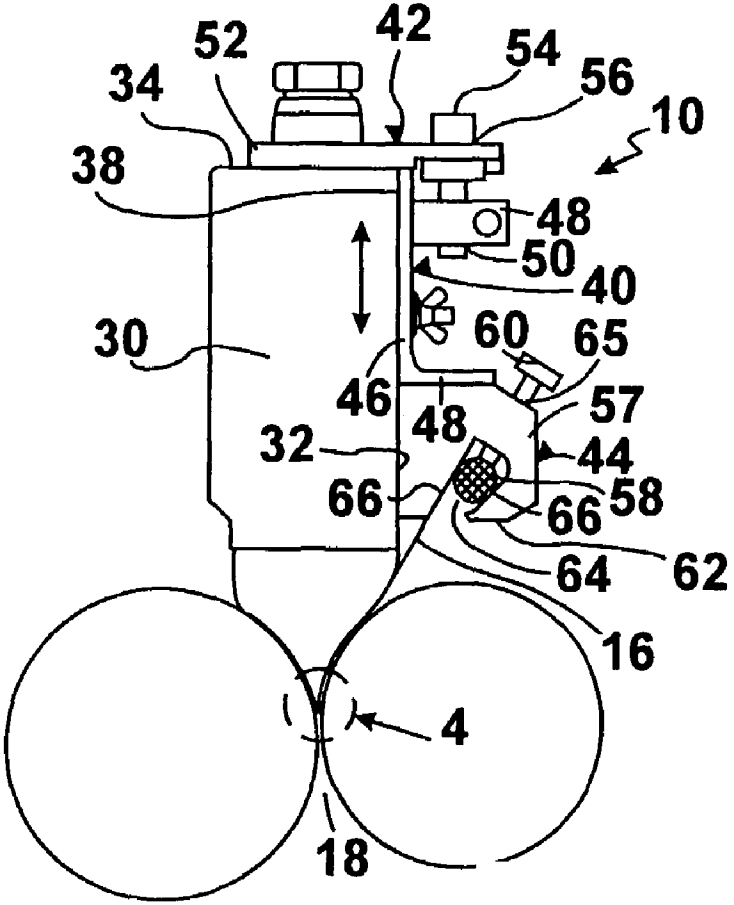
FIG. 3 is an enlarged diagrammatic side elevational view of the area generally enclosed by the dotted curve identified by ARROW 3 in FIG. 2 of the device of the present invention for adjusting the position of the removable slip sheet in the compression zone defined by the pair of rollers of the open width textile compressive shrinking machine to adjust the size of the compression zone for various thickness and types of textiles.

The specific configuration of the device 10 for adjusting the position of the removable slip sheet 16 in the compression zone 18 defined by the pair of rollers 20 of the open width textile compressive shrinking machine 22 to adjust size of the compression zone 18 for various thickness and types of textiles can best be seen in FIGS. 3 and 4, which are, respectively, an enlarged diagrammatic side elevational view of the area generally enclosed by the dotted curve identified by ARROW 3 in FIG. 2 of the device of the present invention for adjusting the position of the removable slip sheet in the compression zone defined by the pair of rollers of the open width textile compressive shrinking machine to adjust the size of the compression zone for various thickness and types of textiles, and, an enlarged diagrammatic side elevational view of the area generally enclosed by the dotted curve identified by ARROW 4 in FIG. 3 of the removable slip sheet in the compression zone, and as such, will be discussed with reference thereto.

The device 10 comprises a bracket 38. The bracket 38 is for having the removable slip sheet 16 depend therefrom and for being movably mounted to the intermediate arm 30 so as to allow the removable slip sheet 16 to move in the compression zone 18.

The bracket 38 comprises a body 40, an adjuster 42, and a retainer 44. The body 40 of the bracket 38 is mounted for up and down movement on the intermediate arm 30. The adjuster 42 of the bracket 38 is for mounting to the intermediate arm 30 and is operatively connected to the body 40 of the bracket 38 so as to allow selectively movement of the body 40 of the bracket 38 up and down on the intermediate arm 30. The retainer 44 is for having the removable slip sheet 16 depend therefrom and is operatively connected to the body 40 of the bracket 38 so as to allow the removable slip sheet 16 to move in the compression zone 18 when the body 40 of the bracket 38 is moved by the adjuster 42 of the bracket 38.

The body 40 of the bracket 38 is substantially C-shaped, and as a result thereof, has an upright portion 46 and a pair of transverse portions 48. The upright portion 46 of the body of the bracket 38 is for mounting to the inner side 32 of the intermediate arm 30. An upper transverse portion 48 of the body 40 of the bracket 38 is operatively connected to the adjuster 42 of the bracket 38, while a lower transverse portion 48 of the body 40 of the bracket 38 has the retainer 44 depend therefrom. The upper transverse portion 48 of the body 40 of the bracket 38 has a threaded through bore 50 that extends axially therethrough, The adjuster 42 of the bracket 38 comprises a plate 52 and a bolt 54. The plate 52 of the adjuster 42 is for affixing to the top 34 of the intermediate arm 30 and extends outwardly therefrom to above and over the upper transverse portion 48 of the body 40 of the bracket 38. The plate 52 of the adjuster 42 has a through bore 56 that extends axially therethrough and which is in alignment with the threaded through bore 50 in the upper transverse portion 48 of the body 40 of the bracket 38.

The bolt 54 of the adjuster 42 depends into the through bore 56 in the plate 52 of the adjuster 42 and threadably into the threaded through bore 50 in the upper transverse portion 48 of the body 40 of the bracket 38 so as to allow the body 40 of the bracket 38 to move up and down on the intermediate arm 30 when the bolt 54 of the adjuster 42 is rotated by virtue of the bolt 54 of the adjuster 42 threading into and out of the threaded through bore 50 in the upper transverse portion 48 of the body 40 of the bracket 38.

The retainer 44 of the bracket 38 comprises a housing 57, a shaft 58, and a bolt 60. The housing 57 depends from the lower transverse portion 48 of the body 40 of the bracket 38 and moves therewith, is for abutting against the inner side 32 of the intermediate arm 30, and has a bottom 62, a cutout 64, and a bore 65. The cutout 64 in the housing 57 of the retainer is defined by downwardly tapering walls 66 which extend laterally therethrough. The cutout 64 in the housing 57 of the retainer 44 communicates with the bottom 62 of the housing 57 of the retainer 44 and is for having the removable slip sheet 16 depend therefrom. The bore 65 in the housing 57 of the retainer 44 extends therethrough, in line with and communicates with the cutout 64 in the housing 57 of the retainer 44.

The shaft 58 of the retainer 44 extends laterally and freely in the cutout 64 in the housing 57 of the retainer 44, is captured in the cutout 64 in the housing 57 of the retainer 44 by the downwardly tapering walls 66 in the housing 57 of the retainer 44, and is for being as wide as the removable slip sheet 16 and is for capturing the removable slip sheet 16 between itself and a wall of the downwardly tapering walls 66 in the housing 57 of the retainer 44.

The bolt 60 of the retainer 44 extends threadably in the bore 65 in the housing 57 of the retainer 44, and when tightened, abuts against and forces the shaft 58 of the retainer 44 against the downwardly tapering walls 66 of the cutout 64 in the housing 57 of the retainer 44 thereby trapping the removable slip sheet 16 between the shaft 58 of the retainer 44 and the wall of the downwardly tapering walls 66 in the housing 57 of the retainer 44.

Figure 5:
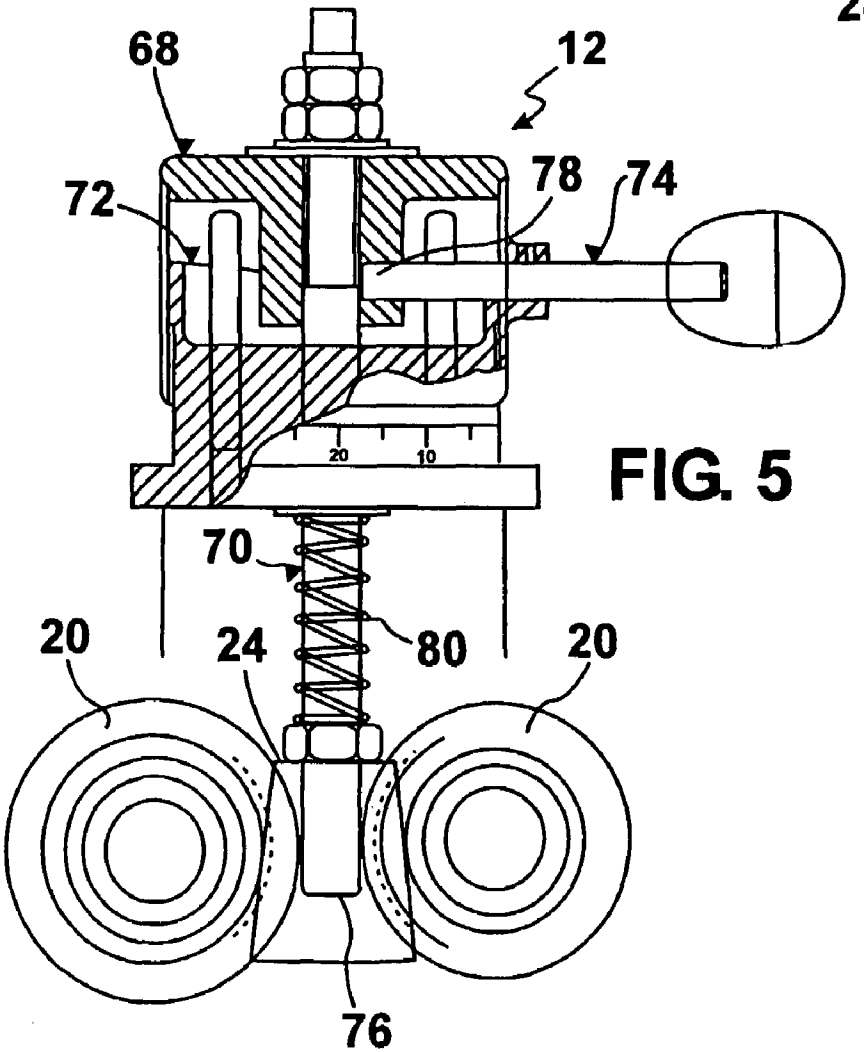
FIG. 5 is an enlarged diagrammatic cross sectional view of the area generally enclosed by the dotted curve identified by ARROW 5 in FIG. 2 of the device of the present invention for adjusting the position of the wedge between the pair of rollers for spacing apart the pair of rollers a predetermined dimension.

The specific configuration of the device 12 for adjusting the position of the wedge 24 between the pair of rollers 20 of the open width textile compressive shrinking machine 22 for spacing apart the pair of rollers 20 a predetermined dimension can best be seen in FIG. 5, which is an enlarged diagrammatic cross sectional view of the area generally enclosed by the dotted curve identified by ARROW 5 in FIG. 2 of the device of the present invention for adjusting the position of the wedge between the pair of rollers for spacing apart the pair of rollers a predetermined dimension, and as such, will be discussed with reference thereto.

The device 12 comprises a housing 68, a shaft 70, an inclined plane 72, and a handle 74. The shaft 70 is mounted in the housing 68, moves up and down therewith, and has a lower end 76 for having the wedge 24 depend therefrom and move therewith.

The inclined plane 72 is contained in the housing 68. The housing 68 moves up and down relative to the inclined plane 72 and is affixed to the shaft 70. The handle 74 extends through the housing 68 and has an inner end 78 that engages the inclined plane 72. The housing 68, with the shaft 70 and the wedge 24 affixed thereto, is caused to move up and down when the handle 74 is rotated by virtue of the inclined plane 70 riding up and down along the inner end 78 of the handle 74.

The shaft 70 has a spring 80 therearound that is external to the housing 68 and which biases the inclined plane 72 against the handle 74.

Figure 6:
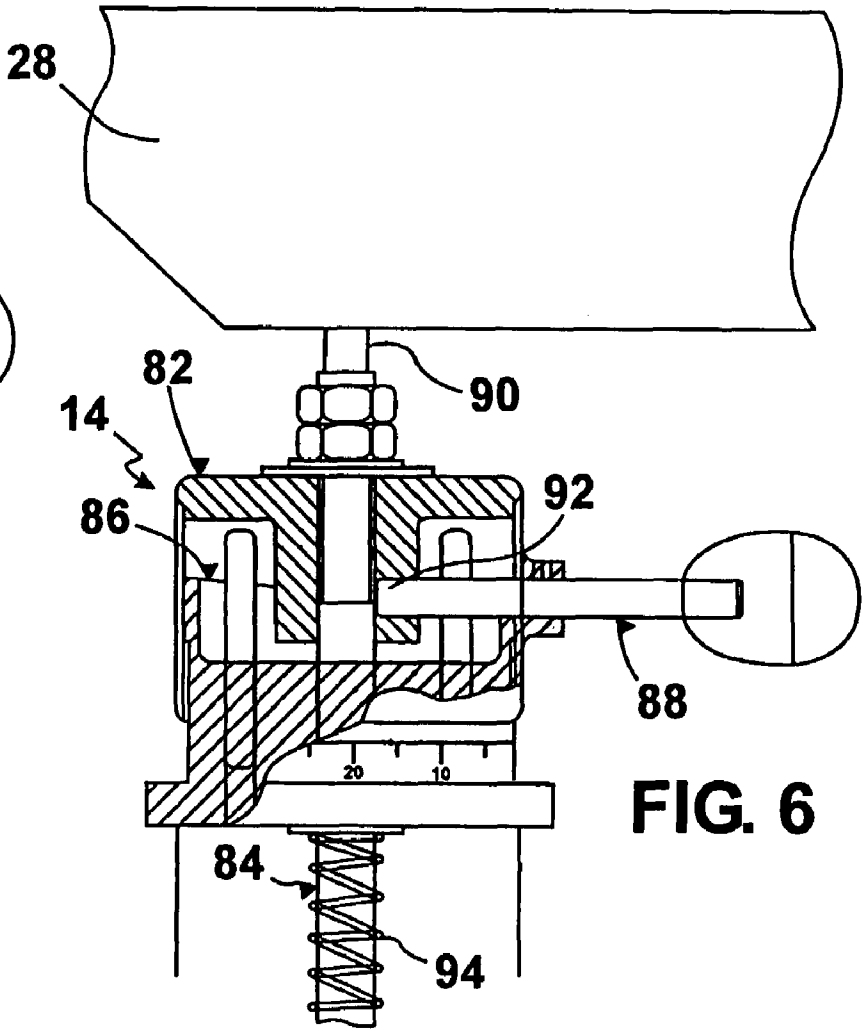
FIG. 6 is an enlarged diagrammatic cross sectional view of the area generally enclosed by the dotted curve identified by ARROW 6 in FIG. 2 of the device of the present invention for adjusting the position of the shoe in the compression zone for allowing for different thickness and types of textiles.

The specific configuration for the device 14 for adjusting the position of the shoe 26 in the compression zone 18 for allowing for different thickness and types of textiles can best be seen in FIG. 6, which is an enlarged diagrammatic cross sectional view of the area generally enclosed by the dotted curve identified by ARROW 6 in FIG. 2 of the device of the present invention for adjusting the position of the shoe in the compression zone for allowing for different thickness and types of textiles, and as such, will be discussed with reference thereto.

The device 14 comprises a housing 82, a shaft 84, an inclined plane 86, and a handle 88. The shaft 84 is mounted in the housing 82, moves up and down therewith, and has an upper end 90 for having the pivot arm 28 stop thereupon.

The inclined plane 86 is contained in the housing 82. The housing 82 moves up and down relative to the inclined plane 86 and is affixed to the shaft 84. The handle 88 extends through the housing 82 and has an inner end 92 that engages the inclined plane 86. The housing 82, with the shaft 84 affixed thereto, is caused to move up and down when the handle 88 is rotated by virtue of the inclined plane 86 riding up and down along the inner end 92 of the handle 88.

The shaft 84 has a spring 94 therearound that is external to the housing 82 and which biases the inclined plane 86 against the handle 88.

It will be understood that each of the elements described above, or two or more together, may also find a useful application in other types of constructions differing from the types described above.

While the invention has been illustrated and described as embodied in devices for adjusting positions of: a removable slip sheet in a compression zone defined by a pair of rollers of an open width textile compressive shrinking machine; a wedge between the pair of rollers; and a shoe in the compression zone, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A device for adjusting a position of a removable slip sheet in a compression zone of an open width textile compressive shrinking machine to adjust a size of the compression zone for various thickness and types of textiles, wherein the compression zone is defined by a pair of rollers of the open width textile compressive shrinking machine, and wherein said device moves with a pivotal arm of the open width textile compressive shrinking machine, via an intermediate arm of the open width textile compressive shrinking machine, said device comprising:

a bracket;

wherein said bracket has the removable slip sheet depending therefrom and is movably mounted to the intermediate arm so as to allow the removable slip sheet to move in the compression zone to adjust for various thickness and types of textiles.

2. The device as defined in claim 1, wherein said bracket comprises a body;

wherein said bracket comprises an adjuster; and wherein said bracket comprises a retainer.

3. The device as defined in claim 2, wherein said body of said bracket is mounted for up and down movement on the intermediate arm.

4. The device as defined in claim 2, wherein said adjuster of said bracket is mounted to the intermediate arm and is operatively connected to said body of said bracket for allowing selectively movement of said body of said bracket up and down on the intermediate arm.

5. The device as defined in claim 2, wherein said retainer has the removable slip sheet depending therefrom and is operatively connected to said body of said bracket for allowing the removable slip sheet to move in the compression zone when said body of said bracket is moved by said adjuster of said bracket.

6. The device as defined in claim 2, wherein said body of said bracket is substantially C-shaped.

7. The device as defined in claim 6, wherein said body of said bracket has an upright portion; and wherein said body of said bracket has a pair of transverse portions.

8. The device as defined in claim 7, wherein the intermediate arm has an inner side;

wherein said upright portion of said body of said bracket is mounted to the inner side of the intermediate arm;

wherein an upper transverse portion of said body of said bracket is operatively connected to said adjuster of said bracket; and wherein a lower transverse portion of said body of said bracket has said retainer depend therefrom.

9. The device as defined in claim 8, wherein said upper transverse portion of said body of said bracket has a threaded through bore; and wherein said threaded through bore extends axially through said upper transverse portion of said body of said bracket.

10. The device as defined in claim 9, wherein said adjuster of said bracket comprises a plate; and wherein said adjuster of said bracket comprises a bolt.

11. The device as defined in claim 10, wherein the intermediate arm has a top;

wherein said plate of said adjuster is affixed to the top of the intermediate arm;

wherein said plate of said adjuster extends outwardly from the top of the intermediate arm;

wherein said plate of said adjuster extends above said upper transverse portion of said body of said bracket; and wherein said plate of said adjuster extends over said upper transverse portion of said body of said bracket.

12. The device as defined in claim 10, wherein said plate of said adjuster has a through bore; and wherein said through bore extends axially through said plate of said adjuster.

13. The device as defined in claim 12, wherein said through bore through said plate of said adjuster is in alignment with said threaded through bore in said upper transverse portion of said body of said bracket.

14. The device as defined in claim 12, wherein said bolt of said adjuster depends into said through bore in said plate of said adjuster and threadably into said threaded through bore in said upper transverse portion of said body of said bracket for allowing said body of said bracket to move up and down on the intermediate arm when said bolt of said adjuster is rotated by virtue of said bolt of said adjuster threading into and out of said threaded through bore in said upper transverse portion of said body of said bracket.

15. The device as defined in claim 10, wherein said retainer of said bracket comprises a housing;

wherein said retainer of said bracket comprises a shaft; and wherein said retainer of said bracket comprises a bolt.

16. The device as defined in claim 15, wherein said housing of said retainer depends from said lower transverse portion of said body of said bracket;

wherein said housing of said retainer moves with said lower transverse portion of said body of said bracket; and wherein said housing of said retainer abuts against the inner side of the intermediate arm.

17. The device as defined in claim 15, wherein said housing of said retainer has a cutout;

wherein said cutout in said housing of said retainer is defined by downwardly tapering walls; and wherein said downwardly tapering walls extend laterally through said housing of said retainer.

18. The device as defined in claim 17, wherein said housing of said retainer has a bottom;

wherein said cutout in said housing of said retainer communicates with said bottom of said housing of said retainer; and wherein said cutout in said housing of said retainer has the removable slip sheet depending therefrom.

19. The device as defined in claim 17, wherein said housing of said retainer has a bore;

wherein said bore in said housing of said retainer extends in line with said cutout in said housing of said retainer; and wherein said bore in said housing of said retainer communicates with said cutout in said housing of said retainer.

20. The device as defined in claim 19, wherein said shaft of said retainer extends laterally in said cutout in said housing of said retainer;

wherein said shaft of said retainer extends freely in said cutout in said housing of said retainer;

wherein said shaft of said retainer is captured in said cutout in said housing of said retainer by said downwardly tapering walls of said cutout in said housing of said retainer;

wherein said shaft of said retainer captures the removable slip sheet between itself and a wall of said downwardly tapering walls of said cutout in said housing of said retainer; and wherein said shaft of said retainer is as wide as the removable slip sheet.

21. The device as defined in claim 20, wherein said bolt of said retainer extends threadably in said bore in said housing of said retainer; and wherein said bolt of said retainer abuts against and forces said shaft of said retainer against said downwardly tapering walls of said cutout in said housing of said retainer thereby trapping the removable slip sheet between said shaft of said retainer and said wall of said downwardly tapering walls of said cutout in said housing of said retainer when said bolt of said retainer is tightened.

* * * * *